US008106287B2

(12) United States Patent
Hasebe

(10) Patent No.: US 8,106,287 B2
(45) Date of Patent: Jan. 31, 2012

(54) TONE CONTROL APPARATUS AND METHOD USING VIRTUAL DAMPER POSITION

(75) Inventor: Masahiko Hasebe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 262 days.

(21) Appl. No.: 12/608,655

(22) Filed: Oct. 29, 2009

(65) Prior Publication Data

US 2010/0107857 A1 May 6, 2010

(30) Foreign Application Priority Data

Nov. 4, 2008 (JP) ..... 2008-283612

(51) Int. Cl.
*G10H 1/02* (2006.01)
*G10H 5/00* (2006.01)

(52) U.S. Cl. ..... 84/662; 84/746

(58) Field of Classification Search ..... 84/626, 84/662, 721, 746

See application file for complete search history.

(56) References Cited

U.S. PATENT DOCUMENTS

| | | | | |
|---|---|---|---|---|
| 5,272,273 | A * | 12/1993 | Watanuki et al. | 84/649 |
| 5,322,967 | A * | 6/1994 | Matsuda | 84/653 |
| 5,350,883 | A * | 9/1994 | Kitamura et al. | 84/644 |
| 5,569,870 | A * | 10/1996 | Hirano | 84/615 |
| 5,648,629 | A * | 7/1997 | Kozuki | 84/660 |
| 7,332,670 | B2 * | 2/2008 | Fujiwara et al. | 84/744 |

FOREIGN PATENT DOCUMENTS

JP 10161658 6/1998

* cited by examiner

*Primary Examiner* — Jeffrey Donels
(74) *Attorney, Agent, or Firm* — Morrison & Foerster LLP

(57) ABSTRACT

Virtual damper position data, simulatively representing a position of a damper member provided for suppressing vibration of a string in a physical tone generating mechanism of the acoustic piano, is generated on the basis of key-on data, key-off data, released key position data, damper pedal position data, sostenute pedal-on data and sostenute pedal-off data. Release characteristic of a tone signal to be generated is controlled on the basis of the virtual damper position data. When the sostenute pedal-on data or key-on data has been supplied, the virtual damper position data is set at a value corresponding to a maximum damper release position. Virtual damper position data is variably generated on the basis of at least one of the released key position data, damper pedal position data supplied after the supply of the sostenute pedal-off data or key-off data.

9 Claims, 6 Drawing Sheets

TONE CONTROL APPARATUS AND METHOD USING VIRTUAL DAMPER POSITION

BACKGROUND

The present invention relates generally to tone control apparatus designed to achieve acoustic effects similar to acoustic characteristics of natural musical instruments, and more particularly to a technique for performing release control intended to achieve an acoustic effect similar to an acoustic characteristic of the acoustic (or natural) piano.

The acoustic (natural) piano is constructed to generate a performance tone in response to key depression operation by a hammer striking a string corresponding to the depressed key. Then, in response to release operation of the depressed key, a damper member corresponding to the key contacts the string to suppress vibration of the string, so that the performance tone is silenced or deadened. Each of the damper members provided in the acoustic piano is controlled in a compound manner in accordance with a plurality of operating factors, such as operational states of the corresponding key, damper pedal and sostenute pedal. Human player can control deadening (volume attenuation) of a currently generated tone by operating the corresponding key, damper pedal and sostenute pedal to control a damper position (i.e., distance between the damper member and the string).

In electronic musical instruments for electronically generating tones, on the other hand, variation over time (i.e., timewise variation) in tone volume of a tone signal to be generated is controlled in accordance with a tone volume envelope signal generated by an envelope generator. Generally, the tone volume envelope signal is controlled in accordance with parameters of an attack rate, decay rate, sustain rate and release rate.

Among various conventionally-known types of electronic keyboard instruments (hereinafter referred to as "electronic pianos") for electronically simulating tones of the acoustic piano is one which includes, as a performance operating member, a release-controlling pedal operator, such as a damper pedal. In this type of electronic piano, it is known to detect a position of the damper pedal to control the release in accordance with the detected position of the damper pedal, and detect a position of a key during release operation of the key to control the release in accordance with the detected position of the key (see, for example, Japanese Patent Application Laid-open Publication No. HEI-10-161658.

However, in the conventionally-known electronic pianos etc., various conditions, such as a position of the damper pedal and a position of a key being released, that become factors for operating the damper member of the key, are individually handled as separate determinants of the release rate; namely, the conventionally-known electronic pianos etc. are constructed to perform release control by merely determining, for each of the conditions, a separate release rate corresponding to the operational state (i.e., position of the operating member (damper pedal, key, or the like)). Namely, with the release control in the conventionally-known electronic pianos etc., there is involved no idea of simulating a physical tone generating mechanism (release control mechanism) of the acoustic piano to determine a release rate using, as a sole parameter, a position of a damper member controlled in a compound manner in accordance with a plurality of operational factors. Because of this, a processing construction for performing the release control is fixedly connected to the hardware arrangements (like a type of the pedal employed, presence/absence of a key release position detecting mechanism, etc.) of the electronic piano, and thus, the processing construction would lack general versatility.

SUMMARY OF THE INVENTION

In view of the foregoing, it is an object of the present invention to provide an improved tone control apparatus for electronically generating tone signals which can realistically reproduce release control of the acoustic piano using a construction simulating a physical tone generating mechanism (release control mechanism) of the acoustic piano, and which can realize such release control of the acoustic piano using a reasonable construction of a high general versatility.

In order to accomplish the above-mentioned object, the present invention provides an improved tone control apparatus for electronically simulating a physical tone generating mechanism of an acoustic piano provided with a damper member for suppressing vibration of a corresponding string, which comprises: a supply section that supplies at least one of key-on data indicative of a start of tone generation, key-off data indicative of a start of tone deadening, released key position data indicative of a position, along a key operating direction, of a key being released, damper pedal position data indicative of a position, along a damper-pedal operating direction, of a damper pedal, sostenute pedal-on data indicative of an ON state of a sostenute pedal and sostenute pedal-off data indicative of an OFF state of the sostenute pedal; a virtual damper position data generation section that generates virtual damper position data on the basis of the at least one of the key-on data, key-off data, released key position data, damper pedal position data, sostenute pedal-on data and sostenute pedal-off data supplied by the supply section, the virtual damper position data being data simulatively representing a position of the damper member provided for suppressing vibration of the corresponding string; a tone signal generation section that generates a tone signal on the basis of the key-on data; and a release control section that, on the basis of the virtual damper position data generated by the virtual damper position data generation section, controls a release characteristic of the tone signal to be generated by the tone signal generation section.

As an example, when the sostenute pedal-on data or the key-on data has been supplied from the supply section, the virtual damper position data generation section sets the virtual damper position data at a value corresponding to a maximum damper release position.

As an example, the virtual damper position data generation section generates the virtual damper position data on the basis of at least one of the released key position data and the damper pedal position data supplied after the supply of the sostenute pedal-off data or the key-off data.

As an example, when both the released key position data and the damper pedal position data have been supplied from the supply section, the virtual damper position data generation section compares the released key position data and the damper pedal position data supplied and generates the virtual damper position data on the basis of one of the released key position data and the damper pedal position data which has a value corresponding to a greater damper release position.

As an example, when only one the released key position data and the damper pedal position data has been supplied from the supply section, the virtual damper position data generation section generates the virtual damper position data on the basis of the released key position data or the damper pedal position data supplied.

According to the present invention, virtual damper position data, simulatively representing a position of a damper member provided for suppressing vibration of a string in the physical tone generating mechanism of the acoustic piano, is generated on the basis of key-on data, key-off data, released key position data, damper pedal position data, sostenute pedal-on data and sostenute pedal-off data, and a release characteristic of a tone signal to be generated is controlled on the basis of the thus-generated virtual damper position data. In this way, the present invention can realistically reproduce the release control performed in the acoustic piano.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
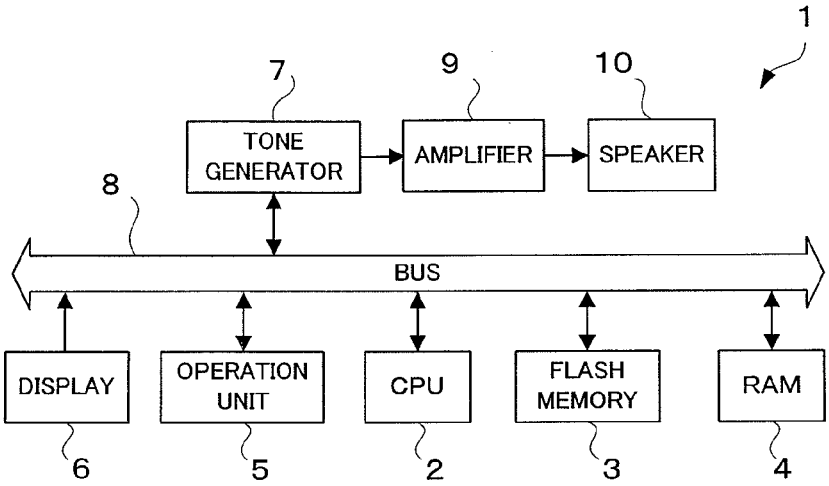
FIG. 1 is a block diagram showing an example general electric hardware setup of an electronic keyboard instrument (electronic piano) to which is applied a tone control apparatus according to an embodiment of the present invention.

FIG. 1 is a block diagram showing an example general hardware setup of a piano-type electronic keyboard instrument (electronic piano) to which is applied a tone control apparatus according to an embodiment of the present invention that performs electronic tone generation control simulating the physical tone generating mechanism of the acoustic piano provided with damper members for suppressing vibration of the corresponding strings. In the electronic piano 1, a CPU 2, flash memory 3 and RAM 4 together constitute a control section (microcomputer) that performs overall control of the electronic piano 1. To the control section are connected, via a bus 8, an operation unit 5, a display section 6 and a tone generator section 7. The flash memory 3 stores therein various control programs to be executed by the CPU 2, data tables, etc. The CPU 2 executes various control programs to control behavior of various sections of the electronic piano 1.

The operation unit 5 includes: keys for instructing a start of sounding and deadening of tone signals; performance operating members, such as pedal operators, operable for release control (tone deadening control); and setting operating members for setting parameters, such as tone color parameters. The operation unit 5 includes a detection section for detecting operation performed by a user (or human operator), and a detection signal responsive to user's operation of the operation unit 5 is supplied to the CPU 2. The CPU 2 generates various data, including MIDI event data (MIDI message), on the basis of the supplied detection signal and performs processing based on the generated various data. The display section 6 displays various information under control of the CPU 2. Note that the MIDI event data are performance data of a format complying with the MIDI (acronym for Musical Instrument Digital Interface) standard and various MIDI event data are defined in advance for various performance operations of the electronic musical instrument.

The tone generator section 7 is in the form of a waveform-memory-based tone generator, which generates tone signals by reproducing waveform data that are recorded in advance in a memory one sample per address. More specifically, once a start of sounding of a tone signal is instructed through user's (human player's) performance operation using the operation unit 5, the tone generator section 7 starts generation of the tone signal on the basis of various MIDI event data supplied from the CPU 2. Once a start of deadening of a tone signal is instructed, the tone generator section 7 starts deadening of the tone signal on the basis of various MIDI event data supplied from the CPU 2. Amplifier 9 amplifies the tone signal, output from the tone generator section 7, in accordance with a predetermined gain value and outputs the amplified tone signal to a speaker 10. The speaker 10 sounds or audibly reproduces the tone signal amplified by the amplifier 9. Whereas the acoustic piano performs deadening control (release control) of a tone signal by physically controlling a position of a damper member provided to suppress vibration of a corresponding string, the electronic piano 1 with no physical tone generating mechanism performs deadening control (release control) of a tone signal by electronically controlling a release rate of a tone volume envelope signal. The present invention is characterized by setting a parameter called "virtual damper position data" using a value of a release rate as a determinant factor, more specifically by generating "virtual damper position data" using a novel construction simulating a physical tone generating mechanism of the acoustic piano.

Figure 2:
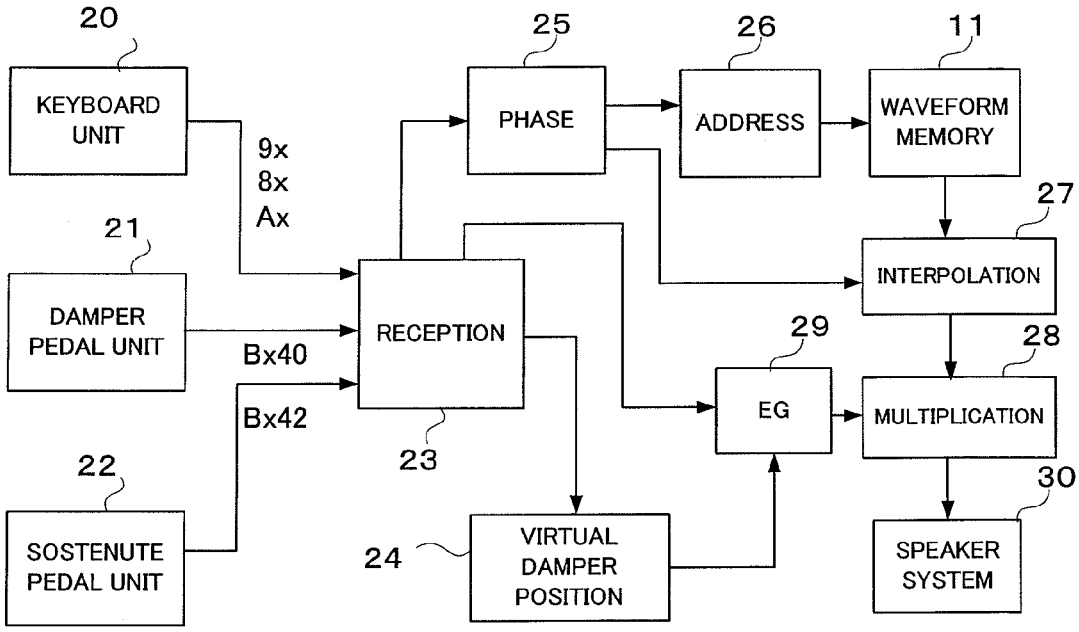
FIG. 2 is a functional block diagram explanatory of a tone generating function of the electronic piano shown in FIG. 1.

FIG. 2 is a functional block diagram explanatory of a tone generating function of the electronic piano 1 shown in FIG. 1. Functions of the individual blocks shown in FIG. 2 are performed by the CPU 2, flash memory 3, RAM 4, operation unit 5, tone generator section 7, amplifier 9 and speaker 10 shown in FIG. 1.

In FIG. 2, a keyboard unit 20, damper pedal unit 21 and sostenute pedal unit 22 included in the operation unit 5 are modules (performance input functions) via which the user performs performance operation and which generate MIDI event data corresponding to the user's performance operation, while the blocks indicated by reference numerals 23-30 are modules which electronically generate a tone signal in response to the user's performance operation. In this specification, the term "module" is used to refer to a functional element constituting the above-mentioned tone generating function.

The keyboard unit 20 includes a keyboard having a plurality of keys (88 keys in the illustrated example) to which are assigned different tone pitches, and a detection mechanism (comprising key sensors) for detecting a current operational position, along a key operating direction, of each key. The user operates a key corresponding to a desired tone pitch, to instruct sounding or audible generation of a tone of that desired tone pitch. The keyboard unit 20 detects displacement of each user-operated key, generates MIDI event data based on the detected result and then outputs the generated MIDI event data to the reception section 23. The MIDI event data generated by the keyboard unit 20 is key-on data 9*x*, key-off data 8*x* or released key position data (polyphonic key pressure data) Ax indicative of an operational position of a key during key release operation (i.e., key being released).

The above-mentioned key sensor may be a conventional key sensor employed in an ordinary electronic piano or piano player as long as it can detect, in continuous values or a plurality of steps of successive values, a changing operational position, along the key operating direction, of each key, i.e. as long as it can detect each intermediate operational position of the key being operated by the user (human player). Among examples of a specific construction of the key sensor employed in a keyboard instrument is the one of an optical key sensor disclosed in Japanese Patent Application Laid-open Publication No. 2004-213043. The optical key sensor disclosed in the No. 2004-213043 publication includes a shutter mounted on the lower surface of a corresponding key, and a sensor box provided under the shutter and containing a light emitting section and a light receiving section. In the disclosed optical key sensor, light emitted by the light emitting section is received by the light receiving section, and an output signal corresponding to an amount of the received light is output. More specifically, once the key is depressed, the light emitted by the light emitting section is blocked by the shutter mounted on the key, so that the amount of the light received by the light receiving section varies in accordance with a changing operational position of the key and thus an analog signal corresponding to the operational position, along the key operating direction, of the key can be obtained.

The released key position data Ax represents or has a value obtained by converting the output signal of the key sensor into digital representation. More specifically, 128 different MIDI values from "0" to "127" are allocated to positions within a range from an end position to a rest position of the key, to output data indicative of a changing position (i.e., intermediate operational position), along the key operating direction, of the key during release operation. The "operating direction of the key" means a direction in which a key is depressed and released, and it is a direction vertical to the general surface of the keyboard. Thus, in this specification, the "operation" in the "operating direction of the key" does not include operation in the horizontal direction of the key (e.g., slide operation in a direction parallel to the keyboard surface). Thus, hereinafter, the "position of the key" refers to a position, along the "operating direction", of the key.

Figure 3:
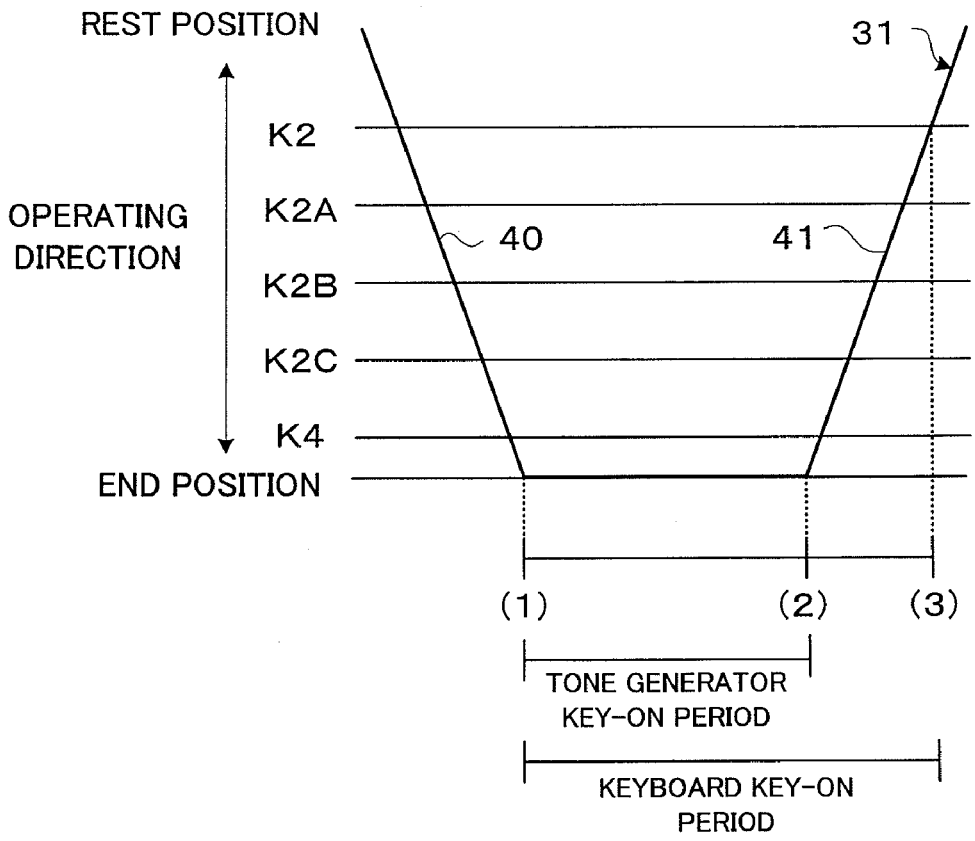
FIG. 3 is a diagram explanatory of relationship between positions, along a key operating direction, of a key (i.e., output signal of a key sensor) and operational states of the key

FIG. 3 is a diagram explanatory of relationship between the positions, along the operating direction, of the key (i.e., output signal of the key sensor) and operational states of the key. In FIG. 3, the vertical axis represents various positions, along the operating direction, of the key, where the upper end position is the rest position of the key while the lower end position is the end position of the key. The rest position is an initial (i.e., non-operated) position of the key, while the end position is a fully-depressed position of the key. Further, the horizontal axis represents the time. In the illustrated example, five threshold values K2, K2A, K2B, K2C and K4 are set for the positions, along the operating direction, of the key. These threshold values serve as criteria for determining the operational state of the key. Reference numeral 31 indicates a trajectory of the key. Of the trajectory of the key, a portion depicted at reference numeral 40 corresponds to "key depression operation" depressing the key from the rest position toward the end position, while a portion depicted at reference numeral 41 corresponds to "key release operation" returning the depressed key toward the rest position.

Generally, there are two major concepts indicative of the operational state of the key, i.e. "key-on" and "key-off". In this specification, the "key-on" concept includes "keyboard key-on" and "tone generator key-on", while the "key-off" concept includes "keyboard key-off" and "tone generator key-off". The "keyboard key-on" and "keyboard key-off" are notions for determining an operational state of a key in the keyboard unit 20 in FIG. 2, while the "tone generator key-on" and "tone generator key-off" are notions for determining an operational state of a key in the tone generator function (reception section 23 in FIG. 2).

The "keyboard key-on" indicates an operational state from a time point when the depressed key has arrived at a predetermined keyboard key-on position (e.g., end position) (time point (1) in FIG. 3) to a time point when, following a start of release operation, the depressed key has passed a predetermined keyboard key-off position (e.g., position of the threshold value K2) (time point (3) in FIG. 3) in a direction from the end position toward the rest position. The "keyboard key-off", on the other hand, indicates an operational state other than the aforementioned keyboard key-on state, i.e. an operational state at a time point when the key is at the rest position or an operational state during key depression operation (till before the depressed key arrives at the predetermined keyboard key-on position from the rest position).

At the time point when the depressed key has arrived at the predetermined keyboard key-on position (e.g., end position) (time point (1) in FIG. 3), the keyboard unit 20 judges that the operational state of the key has turned to the "keyboard key-on" and thus generates key-on data 9*x* for the key. Namely, the generation of the key-on data 9*x* signifies a start of the keyboard key-on state. At the time point when the key in the keyboard key-on state has passed the predetermined keyboard key-off position (position of the threshold value K2 in FIG. 3) (time point (3) in FIG. 3), the keyboard unit 20 judges that the operational state of the key has turned to the "keyboard key-off" and generates key-off data 8*x* for the key. Namely, the generation of the key-off data 8*x* signifies a start of the keyboard key-off state (i.e., end of the keyboard key-on state).

Further, for the key in the keyboard key-on state, the keyboard unit 20 starts generating released key position data Ax once release operation of the key is started. Namely, the released key position data Ax is generated only while the key is within the region from time point (2) to time point (3) of FIG. 3.

The "tone generator key-on" indicates an operational state from a time point when the depressed key has arrived at a predetermined key-on position (e.g., end position) (time point (1) in FIG. 3) to a time point when release operation has been started (time point (2) in FIG. 3). The "tone generator key-off", on the other hand, indicates an operational state other than the aforementioned keyboard key-on, i.e. an operational state at a time point when the key is at the rest position or an operational state during key depression operation (till before the depressed key arrives at the predetermined keyboard key-on position) or during key release operation (i.e., while the key is within the region from (2) to (3) in FIG. 3). As will be later described, the tone generator function depicted at reference numerals 23-30 starts generation of a tone signal in response to the start of the "tone generator key-on" and starts deadening of the tone signal in response to the start of the "tone generator key-off" (i.e., end of the tone generator key-on").

Referring back to FIG. 2, the damper pedal unit 21 includes a step-down press-down type pedal operator, and a damper pedal sensor for detecting, in continuous or successive values, a changing position (pressed-down amount), along a damper-pedal operating direction, of the press-down pedal operator. The damper pedal unit 21 generates damper pedal position data Bx40 corresponding to the detected position and output the generated damper pedal position data Bx40 to the reception section 23. The damper pedal provided in the damper pedal unit 21 is a pedal for achieving a performance effect similar to behavior of the damper pedal provided in the acoustic piano, i.e. similar to the operation of collectively moving the damper members corresponding to keys (notes). The operating direction of the damper pedal is a direction in which the damper pedal is stepped or pressed down and returned to its rest position, and it is a direction vertical to the general surface of the keyboard. Note that, although the instant embodiment includes the damper pedal, it does not include damper members provided in corresponding to the individual keys and thus performs the damper function in a virtual manner as will be later detailed.

The damper pedal sensor may be of any type or construction as along as it can detect in real time, in response to operation of the damper pedal, a changing position (pressed-down amount) of the damper pedal. For example, the damper pedal sensor may be an angle sensor constructed to detect, in continuous or successive values, a changing rotational angle of a rotation member having the pedal pivotably supported thereon; more specifically, the angle sensor may detect a changing rotational angle of the rotation member, rotating in response to pressing-down operation of the damper pedal, as a changing position, along the operating direction, of the damper pedal. In the following description, the position, along the operating direction, of the damper pedal will be referred to simply as "damper pedal position". The damper pedal sensor may be provided on other than a portion of the damper pedal, such as on a portion of the body of the electronic piano near the keyboard, as long as it can detect a damper pedal position.

Damper pedal position data Bx40 represents or has a value obtained by converting the output signal of the damper sensor, and MIDI values ranging from "0" to "127" are allocated in advance as values of the damper pedal position data Bx40. The damper pedal position data Bx40 is expressed with a sensor detection resolution of four or five steps with respect to a movable range of the damper pedal.

The sostenute pedal unit 22 includes a step-down or press-down pedal operator (sostenute pedal), and a sostenute pedal sensor for detecting a current operational state in any one of two values indicative of ON and OFF states, and it generates sostenute pedal data Bx42 corresponding to the detected result of the sostenute pedal sensor and outputs the thus-generated sostenute pedal data Bx42 to the reception section 23. The sostenute pedal data Bx42 output to the reception section 23 is sostenute pedal ON data indicating that the sostenute pedal is currently in the ON state or sostenute pedal OFF data indicating that the sostenute pedal is currently in the OFF state. The sostenute pedal provided in the sostenute pedal unit 22 is a pedal for achieving a performance effect similar to that achieved by the sostenute pedal of the acoustic piano, i.e. similar to behavior of the sostenute pedal of the acoustic piano that, by being stepped down by a human player, locks the damper member, corresponding to a currently depressed key, in a position separated from the string. MIDI values "0" and "127" are allocated as values of the sostenute pedal data Bx42, of which the value "0" is assigned to the sostenute pedal ON data and the value "127" is assigned to the sostenute pedal OFF data.

Figure 8:
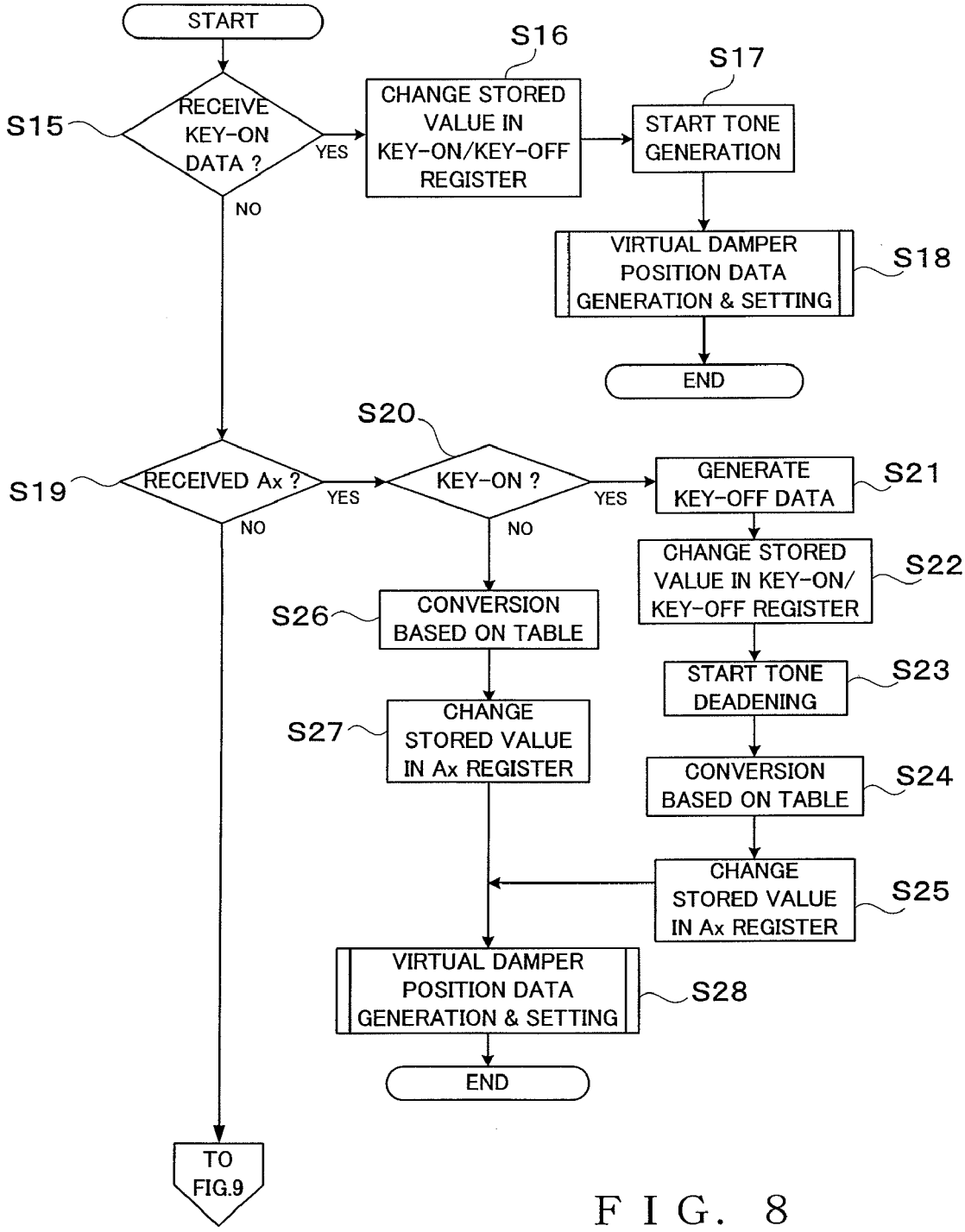
FIG. 8 is a flow chart showing a portion of a sequence of operations of a process performed by a reception section shown in FIG. 2.
Figure 9:
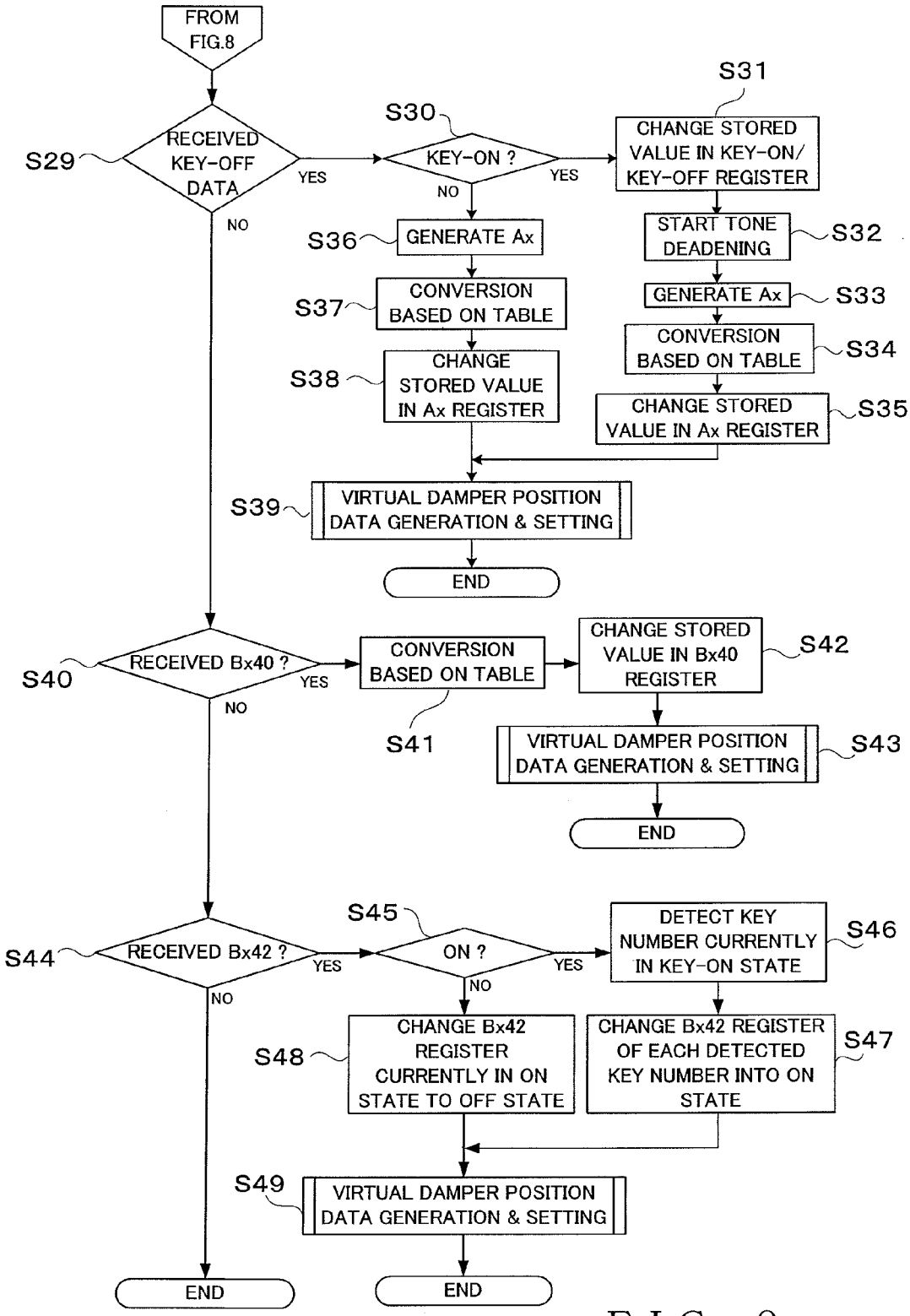
FIG. 9 is a flow chart showing the remaining portion of the sequence of operations of the process performed by the reception section.

The reception section 23 is a module that performs an interface function that, upon receipt of the MIDI event data (key-on data 9*x*, key-off data 8*x*, released-key position data Ax, damper pedal position data Bx40 and sostenute pedal data Bx42 (sostenute pedal-on data and sostenute pedal-off data)) from the keyboard unit 20, damper pedal unit 21 or sostenute pedal unit 22, it executes a process of FIGS. 8 and 9 to interpret the received MIDI event data and then transfers the MIDI data to the virtual damper position data generation section 24, phase generation section 25 and envelope generation section 29.

The reception section 23 also includes registers for retaining current values of various event data on the basis of the MIDI event data received by the above-mentioned components. The above-mentioned registers include a key-on/key-off register for retaining a value indicative of either the "tone generator key-off" or the "tone generator key-on" state, an Ax register for retaining a current value of the released key position data Ax, a Bx40 register for retaining a current value of the damper pedal position data Bx40, and a Bx42 register for retaining either the "sostenute pedal-on" or the "sostenute pedal-off" state. One such key-on/key-off register, Ax register and Bx42 register are provided per key (notes) of the keyboard. Further, the same Bx40 register is shared among all of the keys (notes). Let it be assumed that these registers are provided in the RAM 4.

The virtual damper position data generation section 24 is a module that generates "virtual damper position data" on the basis of MIDI event data transferred from the reception section 23. The "virtual damper position data" is data simulatively representing a position of a damper member provided for suppressing vibration of a corresponding string in the acoustic piano. The virtual damper position data generated by the virtual damper position data generation section 24 is supplied to the envelope generation section 29, where it is used as a sole parameter for controlling a release rate of an envelope signal to be generated by the envelope generation section 29.

In the acoustic piano, the damper members are provided in corresponding relation to the keys (tone pitches), and a felt is provided on a portion of each of the damper members contacting the corresponding string. When audible generation or sounding of a performance tone is to be terminated (deadened), the felt is brought into contact with the string to mute the performance tone, while, when a performance tone is to be sounded or audibly generated, the felt is brought out of contact with the string to permit vibration of the string (sounding of the performance tone). There are three operating factors of the damper member: (1) operation, by a human player, of the corresponding key; (2) operation, by the human player, of the damper pedal; and (3) and operation, by the human player, of the sostenute pedal. In the acoustic piano, the damper member operates in response to operation of the key. Namely, in response to depression operation of the key, the damper member moves away from the corresponding string, and, in response to release operation of the key, a distance between the damper member and the string decreases (i.e., the damper moves toward the string) in proportion to a position of the key (i.e., released key position). Further, the damper member operates in response to operation of the damper pedal in such a manner that the distance between the damper member and the string increases (i.e., the damper member moves away from the string) in proportion to a pressed-down amount of the damper pedal. Furthermore, the damper member operates in response to operation of the sostenute pedal in such a manner that the damper member corresponding to the key being depressed at the time of pressing-down of the sostenute pedal is locked at the remotest position from the string.

The virtual damper position data generation section 24 generates virtual damper position data through a later-described virtual damper position data setting and generation process on the basis of at least one of the key-on data 9*a*, key-off data 8*x*, released key position data Ax, damper pedal position data Bx40 and sostenute pedal data Bx42 (sostenute pedal ON data or sostenute pedal OFF data). In this way, the virtual damper position data generation section 24 simulates the construction of the physical tone generating mechanism (release control mechanism) of the acoustic piano for controlling the damper position (i.e., distance between the damper member and the string) in a compound manner on the basis of a plurality of operating factors.

The virtual damper position data is data indicating any one of positions within a virtual movable range of the virtual damper from a position of a predetermined minimum value to a position of a predetermined maximum value in any one of 128 different values from "0" to "127". The movable range of the damper member in the acoustic piano is from a position where the acoustic piano damper member is in full contact with the corresponding string (muting the corresponding string) to a position where the damper member is located remotest from the corresponding string. The minimum value of the virtual damper position data corresponds to a state where the acoustic piano damper member is in full contact with the corresponding string and thus corresponds to a position of the damper member when the corresponding key is not being operated at all (i.e., the key is at its rest position).

Further, the maximum value of the virtual damper position data corresponds to a state where the acoustic piano damper member is located remotest from the corresponding string. More specifically, the maximum value of the virtual damper position data corresponds to a position of the damper member when a start of tone generation has been instructed through key depression operation, a position of the damper member when the damper pedal has been pressed down to its maximum value, a position of the damper member when damper locking by the sostenute pedal is in progress, etc.

The phase generation section 25, address generation section 26, waveform memory 11, interpolation section 27 and multiplication section 28 are blocks for performing tone signal generation processing. Key number (tone pitch) and key-on data 9*x* (or key-off data 8*x*) are transferred from the reception section 23 to the phase generation section 25. Once the key-on data 9*x* is input, the phase generation section 25 generates phase information corresponding to the key number input together with (or defined in) the key-on data 9*x*. More specifically, the phase generation section 25 accumulates an F number (i.e., value including a fractional part), corresponding to a tone pitch (key number) to be sounded, every sampling period, the result of which is provided as the phase information. The phase information comprises an integral part and a fractional part. The integral part of the phase information is supplied to the address generation section 26, while the fractional part of the phase information is supplied to the interpolation section 27.

The address generation section 26 adds the leading address of waveform data in question etc. to the integral part of the phase information supplied from the phase generation section 25 to thereby generate an address signal to be used to access the waveform memory 11, accesses the waveform memory 11 using the thus-generated address signal, and then reads out a waveform sample from the address of the waveform memory 11. In the illustrated example, it is assumed that the waveform data stored in the waveform memory 11 comprises a waveform of an attack portion and a waveform of a loop portion, and thus, the address generation section 26 first reads out waveform samples of the attack portion using the address signals output from the address generation section 26 and then repetitively reads out waveform samples of the loop portion designated by a loop readout section of the waveform memory 11.

Every sampling period, a waveform sample designated by the address signal output from the address generation section 26 is output from the waveform memory 11. Further, every sampling period, the interpolation section 27 performs sample-to-sample interpolation to interpolates between the waveform samples, read out from the waveform memory 11, using the fractional part of the phase information, and then outputs an interpolated waveform sample to the multiplication section 28. For example, the sample-to-sample interpolation performed here may be performed by interpolating between two successive waveform samples (i.e., waveform samples read out in the preceding sampling period and current sampling period) through suitable interpolating arithmetic operations. The interpolating arithmetic operations may use two or more successive waveform samples.

The envelope generation section (EG) 29 is supplied with the key number (tone pitch) and key-on data 9*x* (or key-off data 8*x*) from the reception section 23 and the virtual damper position data output from the virtual damper position data generation section 24. Thus, the envelope generation section (EG) 29 generates a tone volume envelope signal for controlling variation over time of a tone volume of a tone signal to be generated and outputs the thus-generated tone volume envelope signal to the multiplication section 28, every sampling period. Hereinafter, the "tone volume envelope signal" will also sometimes be referred to simply as "envelope signal". Note that a pitch envelope, tone color envelope (filter envelope), etc. as well as the tone volume may be controlled in accordance with the virtual damper position data.

Figure 4:
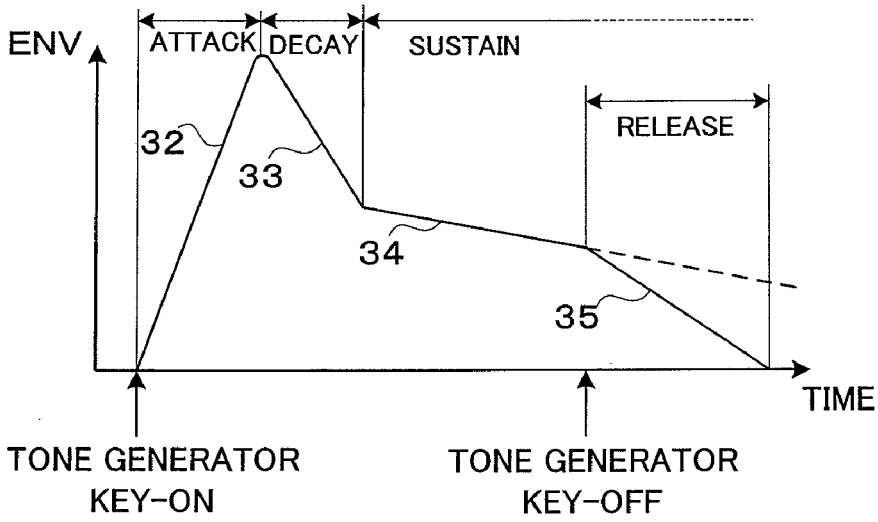
FIG. 4 is a diagram explanatory of a tone volume envelope signal for a piano tone color generated by an envelope generation section.

FIG. 4 is a diagram explanatory of a tone volume envelope signal for a piano tone color generated by the envelope generation section 29, where the vertical axis represents tone volume levels of the envelope signal while the horizontal axis represents the time. Shape of the envelope signal is controlled in accordance with a plurality of parameters of an attack rate, decay rate, sustain rate and release rate, and, basically, each of these parameters is set at a given value on the basis of various MIDI event data (such as a currently-set tone color, and tone volume (velocity), tone pitch (key number), etc. of a tone signal to be generated) transferred from the reception section 23. However, the present invention is characterized in that, of the parameters of the envelope signal, a value of the release rate is set on the basis of the virtual damper position data generated by the virtual damper position data generation section 24.

Of the parameters of the envelope signal, the attack rate is a parameter for controlling a time length from a start of sounding or audible generation of a tone, immediately after tone generation start timing, to a time point when a maximum tone volume level (attack level) is reached, which defines a slope of a portion (attack portion) indicated at 32 in the figure. The decay rate is a parameter for controlling a time length over which a tone attenuates from a maximum amplitude to a sustain level, which defines a slope of a portion (decay portion) indicated at 33 in the figure. The sustain rate is a parameter for controlling a time length over which the tone completely attenuates from a sustain level, which defines a slope of a portion (sustain portion) indicated at 34 in the figure. Tone volume attenuation characteristic indicated by the sustain rate corresponds to a characteristic of natural or spontaneous attenuation (i.e., tone volume attenuation in a case where vibration of the string is not suppressed by the damper member) of a performance tone of the acoustic piano. Further, the release rate is a parameter for controlling a time length from tone deadening timing to a time point when a tone volume completely attenuates, which defines a slope of a portion (release portion) indicated at 35 in the figure.

Every sampling period following the start of the "tone generator key-on" (point (1) in FIG. 3), the envelope generation section (EG) 29 sequentially outputs values of the attach rate, decay rate and sustain rate of the various envelope signal parameters to generate envelope signals corresponding to the attack, decay and sustain portions. Further, every sampling period following the start of the "tone generator key-off" (point (2) in FIG. 3), the envelope generation section (EG) 29 outputs a value of the release rate of the envelope signal parameters to generate an envelope signal corresponding to the release portion. Namely, the release control is started in response to the start of the "tone generator key-off", so that a release portion is formed on the basis of a release rate determined in accordance with the virtual damper position data varying in real time.

The multiplication section 28 multiplies the interpolated waveform sample, output from the interpolation section 27, by the tone volume envelope signal output from the envelope generation section 29, to thereby impart the waveform sample with an envelope (variation over time of the tone volume). Every sampling period, a waveform sample imparted with the envelope by the multiplication section 28 is output to the speaker system 30 including a D/A converter, amplifier, speaker, etc. The speaker system 30 sounds or audibly generates a tone signal generated and imparted with an envelope through actions of the aforementioned sections.

Next, behavior of the aforementioned various sections will be described with reference to flow charts of FIGS. 5-11. Whereas various processes shown in FIGS. 5-11 will be described below as performed by respective modules (such as the keyboard unit 20) assigned thereto, what actually performs these processes in a hardware manner is the CPU 2 shown in FIG. 1.

Figure 5:
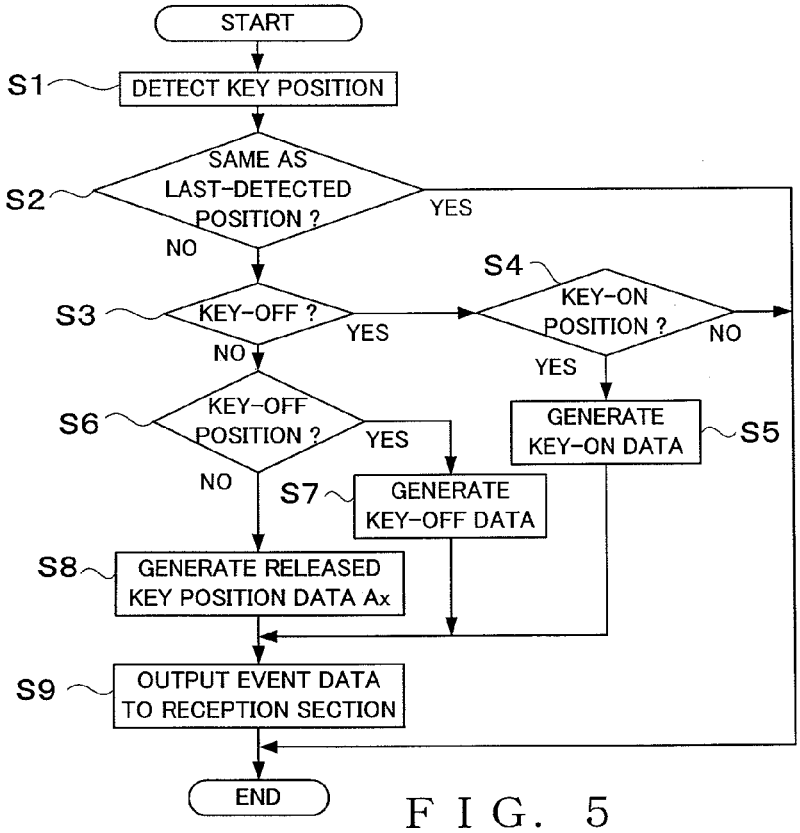
FIG. 5 is a flow chart showing a sequence of operations of a process performed by a keyboard unit shown in FIG. 2.

FIG. 5 is a flow chart showing a sequence of operations of a process performed the keyboard unit 20 of FIG. 2. This process is implemented by a software program executed by the CPU 2, and it is started up or activated for individual ones of the 88 keys of the keyboard every predetermined period (e.g., 50 ms). In this way, the keyboard unit 20 checks respective current operational states of the 88 keys of the keyboard every predetermined period.

At step S1 of FIG. 5, the keyboard unit 20 obtains an output signal of each of the key sensors to detect a current position of the corresponding key. As noted above, a value indicative of the current position of each of the keys (i.e, output signal of the key sensor) is data that indicates, with a resolution of 128 steps, a position within the range (movable range, in the operating direction, of the key) from the end position to the rest position. At next step S2, the keyboard unit 20 determines whether the current position of the key detected at step S1 is the same as the last-detected position, i.e. whether the position of the key detected at step S1 has not changed from the last-detected position.

If the position of the key detected at step S1 has changed from the position detected at the last processing timing or last-detected position (i.e., with a NO determination at step S2), the keyboard unit 20 proceeds to step S3. If, on the other hand, the position of the key detected at step S1 has not changed from the last-detected position (i.e, with a YES determination at step S2), the keyboard unit 20 terminates the current process for the key in question. YES determination is made at step S2, for example, when the key in question is continuing to remain at the rest position without being operated or depressed, when the key is continuing to remain depressed to the end position (as indicated by a straight horizontal-line region in the trajectory 31 shown in FIG. 3), or the like.

At step S3, the keyboard unit 20 determines whether or not the last operational state of the detected key is the "keyboard key-off" state. If the detected key is not currently in the "keyboard key-off" state, i.e., the detected key is currently in the "keyboard key-on" state as determined at step S3, the process branches to step S6.

If the detected key is currently in the "keyboard key-off" state as determined at step S3 (YES determination at step S3), the keyboard unit 20 determines, at step S4, whether or not the current position of the key is a keyboard key-on position. Because the end position is set as the keyboard key-on position in the illustrated example of FIG. 3, the keyboard unit 20 determines, at step S4, whether the key has reached the end position. If the key has reached the end position (YES determination at step S4), the keyboard unit 20 judges that the key has reached the keyboard key-on position at the current processing timing, so that it then generate key-on data 9*x* at step S5. The key-on data 9*x* includes a command instructing the tone generator section 7 to start tone generation, a key number indicative of a tone pitch to be generated (i.e., tone pitch of the key), and velocity data indicative of an intensity of key depression.

If the detected key is currently in the "keyboard key-off" state (YES determination at step S3) and not in the keyboard key-on position (end position) (NO determination at step S4), then the keyboard unit 20 judges that the key is in the middle of being depressed (key depression operation) from the rest position toward the end position as indicated at 40 in FIG. 3, and thus, it terminates the process for the key in question without generating MIDI event data for the key at the current processing timing.

If the detected key is currently in the "keyboard key-on" state (NO determination at step S3), the keyboard unit 20 determines, at step S6, whether or not the current position of the key is a keyboard key-off position. Because the position of the threshold value K2 is set as the keyboard key-off position in this example, the keyboard unit 20 determines whether or not the key is currently located closer to the rest position than the position of the threshold value K2. If the key is currently located closer to the rest position than the position of the threshold value K2 (YES determination at step S6), the keyboard unit 20 judges that the keyboard key-on has been terminated at the current processing timing and then generates key-off data 8*x* at step S7. The key-off data 8*x* includes a command instructing the tone generator section 7 to terminate tone generation (start tone deadening), and a key number indicative of a tone pitch to be deadened (i.e., tone pitch of the key).

The determination that the detected key is currently in the "keyboard key-on" state (NO determination at step S3) and the determination that the detected key is the currently located closer to the end position than the position of the threshold value K2 (NO determination at step S6) are made only when the key is currently in the middle of being released (key release operation) as indicated at 41 in FIG. 3. That the key is in the middle of key release operation means that the key having been depressed to the keyboard key-on (end position) is now returning toward the rest position. In such a case, the keyboard unit 20 proceeds to step S8 to generate released key position data Ax corresponding to the position of the key detected at step S1. The released key position data Ax includes data indicative of the position, along the operating direction, of the key at the time of the key being released (i.e., position of the key detected at step S1), and information indicating of which tone pitch (i.e., key number) the data indicative of the position is.

At step S9, the key-on data generated at step S5, key-off data 8*x* generated at step S7 or released key position data generated at step S8 is output to the reception section 23.

Figure 6:
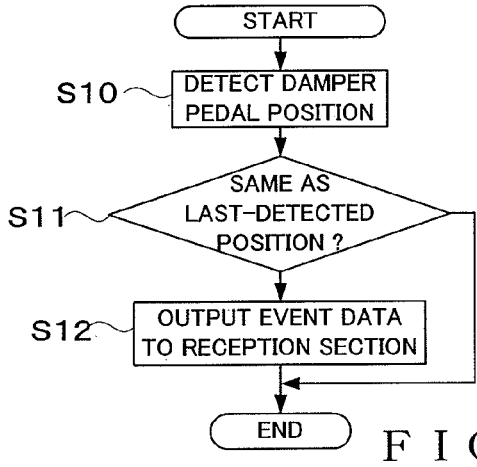
FIG. 6 is a flow chart showing a sequence of operations of a process performed by a damper pedal unit shown in FIG. 2.

FIG. 6 is a flow chart showing a sequence of operations of a process performed by the damper pedal unit 21 shown in FIG. 2. This process is implemented by a software program executed by the CPU 2, and it is started up every predetermined period (e.g., 10 ms). Namely, the start-up frequency of the process performed by the damper pedal unit 21 is lower than that of the process performed by the keyboard unit 20 shown in FIG. 5.

At step S10, the damper pedal unit 21 receives an output signal of the damper pedal sensor to detect a current position of the damper pedal. The damper pedal sensor is a rotational angle sensor that, as noted above, detects a pressed-down amount (position) of the damper pedal with the sensor detection resolution of four or five steps with respect to the movable range of the damper pedal. At next step S11, the damper pedal unit 21 determines whether or not the current position of the damper pedal detected at step S11 is the same as the last-detected position, i.e. whether the position of the damper pedal detected at step S11 has not changed from the last-detected position. If the position of the damper pedal detected at step S11 has changed from the last-detected position (NO determination at step S11), the damper pedal unit 21 proceeds to step S12 to generate damper pedal position data Bx40 corresponding to the detected current position of the damper pedal and output the generated damper pedal position data Bx40 to the reception section 23.

Figure 7:
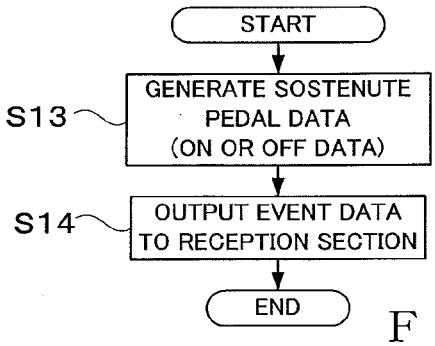
FIG. 7 is a flow chart showing a sequence of operations of a process performed by a sostenute pedal unit shown in FIG. 2.

FIG. 7 is a flow chart showing a sequence of operations of a process performed by the sostenute pedal unit 22 shown in FIG. 2. This process is implemented by a software program executed by the CPU 2, and it is started each time human player's operation of the sostenute pedal unit 22 is detected. Output signal from the sostenute pedal sensor takes any one of two values indicative of ON and OFF states. Thus, at step S13 of FIG. 7, the sostenute pedal unit 22 generates sostenute pedal data Bx42, i.e. sostenute pedal-on data upon detection of pressing-down operation of the sostenute pedal or sostenute pedal-off data upon detection of pressing-down release operation of the sostenute pedal, and outputs, at step S14, the thus-generated sostenute pedal-on or sostenute pedal-off data Bx42 to the reception section 23.

FIGS. 8 and 9 are a flow chart showing a sequence of operations of a process performed by the reception section 23 shown in FIG. 2. The reception section 23 performs the process of FIGS. 8 and 9 upon receipt of any one of the MIDI event data, i.e. key-on data 9*x*, key-off data 8*x*, released key position data Ax, damper pedal position data Bx40, sostenute pedal-on data Bx42 and sostenute pedal-off data Bx42, from the keyboard unit 20, damper pedal unit 21 or sostenute pedal unit 22. This process too is implemented by a software program executed by the CPU 2.

When key-on data 9*x* has been received from the keyboard unit 20 (YES determination at step S15), the reception section 23 goes to step S16 to change the stored value in the key-on/key-off register, corresponding to a tone pitch of a key number included in the received key-on data 9*x*, to the value indicative of the key-on state (i.e., tone generator key-on). Then, at step S17, the reception section 23 transfers the received key-on data 9*x* and the key number, included in the received key-on data 9*x*, to the phase generation section 25 and envelope generation section 29 to cause the phase generation section 25 and envelope generation section 29 to generate a tone signal based on the received key-on data 9*x*. Further, at step S18, the reception section 23 causes the virtual damper position data generation section 24 to perform the later-described virtual damper position data generation and setting process of FIG. 10 on the key number included in the received key-on data 9*x* (i.e., tone pitch to be processed).

Further, when released key position data Ax has been received from the keyboard unit 20 (YES determination at step S19), the reception section 23 goes to step S20 to determine whether or not the current stored value in the key-on/key-off register, corresponding to a tone pitch indicated by a key number included in the received released key position data Ax, is the value indicative of the key-on state (i.e., tone generator key-on), to thereby determine whether or not a tone signal of the tone pitch indicated by the key number included in the received released key position data Ax is being currently sounded. If the current stored value in the key-on/key-off register, corresponding to the tone pitch indicated by a key number included in the received released key position data Ax, is the value indicative of the key-on state (YES determination at step S20), it means that the released key position data Ax is one having been received for the first time for tone generation of the tone pitch indicated by the key number, and the reception time of the current released key position data Ax corresponds to the time point (2) shown in FIG. 3. In this case, tone generator key-off (tone deadening) of the tone pitch corresponding to the released key position data Ax received this time is to be started.

After the YES determination at step S20, the reception section 23 goes to step S21 to terminate the tone generation (i.e., tone generator key-on) of the tone pitch indicated by the key number included in the received released key position data Ax. Namely, the reception section 23 generates key-off data 8*x* for deadening the currently-sounded tone signal corresponding to the tone pitch and then goes to step S22 to change the current stored value in the key-on/key-off register, corresponding to the tone pitch indicated by the key number and indicative of the key-on state, to the value indicative of the key-off state (i.e., tone generator key-off). Then, at step S23, the reception section 23 transfers the generated key-off data 8*x* and the key number, included in the key-off data 9*x*, to the phase generation section 25 and instructs the envelope generation (EG) section 29 to start deadening of the tone signal corresponding to the tone pitch of the current received released key position data Ax.

Note that the "deadening of the tone signal" includes an operation (or release control) for starting output of a release portion of the envelope signal and attenuating the tone signal in accordance with a current release rate. The present invention is characterized by determining the release portion of the envelope signal in the release control of the tone deadening control. For other operations pertaining to the tone deadening control, there may be employed suitable techniques conventionally known in the field of electronic pianos etc.

Following step S23, the reception section 23 goes to step S24, where the value of the released key position data Ax is converted into a value corresponding to virtual damper position data on the basis of an Ax data conversion table. Then, at step S25, the reception section 23 changes the current stored value in the Ax register corresponding to the tone pitch of the current received released key position data Ax, by changing the value of the Ax register with the converted value (i.e., by overwriting the value of the Ax register with the converted value).

The Ax data conversion table is a data table prestored in the flash memory 3 or RAM 4, which defines, for each possible value of released key position data Ax (i.e., for each possible key position), to which one of values capable of being taken by the virtual damper position data (i.e., values of a virtual movable range of the virtual damper) the value of the released key position data Ax corresponds.

The following describe the purpose of the Ax data conversion table. The virtual damper position data generation section 24 generates, in response to each of released key position data Ax and damper pedal position data Bx40, virtual damper position data based on a position indicated by the position data Ax or Bx40. Values of the released key position data Ax and damper pedal position data Bx40 are independent values having no relationship therebetween, because the value of the released key position data Ax indicates an operational position of a key while the value of the damper pedal position data Bx40 indicates an operational position of the damper pedal. Therefore, it is preferable that the virtual damper position data generation section 24 handle these values of the released key position data Ax and damper pedal position data Bx40 after converting the values into values of the same or common virtual movable range rather than handling them directly as virtual damper position data. Namely, in the physical tone generating mechanism of the acoustic piano, even when a position (depth), along the operating direction, of a key being released and a pressed-down amount of the damper pedal are physically of the same value (e.g., in a case where each of the key and the damper pedal has been moved by one centimeter), an amount of displacement of the damper member corresponding to the depth of the key release and an amount of displacement of the damper member corresponding to the pressed-down amount of the damper pedal would differ from each other. Thus, in the instant embodiment of the tone control apparatus intended to simulate the construction of the physical tone generating mechanism of the acoustic piano, there is employed the Ax data conversion table for converting released key position data Ax into a value corresponding to virtual damper position data, in order to absorb a difference between an operational characteristic of the damper member responsive to the key release operation and an operational characteristic of the damper member responsive to operation of the damper pedal.

If the current stored value in the key-on/key-off register, corresponding to the tone pitch indicated by the key number included in the received released key position data Ax, is already the value indicative of the key-off state (i.e., tone generator key-off) (NO determination at step S20) when the released key position data Ax has been received from the keyboard unit 20 (YES determination at step S19), it means that the tone signal corresponding to the tone pitch indicated by the key number included in the received released key position data Ax is currently already in the middle of tone deadening control. Thus, in this case, the reception section 23 goes to step S26, where the value of the released key position data Ax is converted into a value corresponding to virtual damper position data on the basis of the above-mentioned Ax data conversion table. Then, at step S27, the reception section 23 changes the current stored value in the Ax register corresponding to the tone pitch of the current received released key position data Ax, by changing the value of the Ax register with the converted value (i.e., by overwriting the value of the Ax register with the converted value).

After the change of the value of the Ax register at step S25 or S27, the reception section 23 goes to step S28, where the virtual damper position data generation section 24 is caused to start the later-described virtual damper position data generation and setting process of FIG. 10 on the key number included in the current received released key position data Ax (i.e., tone pitch to be processed).

Further, when key-off data 8*x* has been received from the keyboard unit 20 (YES determination at step S29), and if the current stored value in the key-on/key-off register, corresponding to the tone pitch indicated by the key number included in the received key-off data 8*x* is the value indicative of the key-on state (YES determination at step S30), the reception section 23 goes to step S31 to change the current stored value in the key-on/key-off register to the value indicative of the key-off state. Then, at step S32, the reception section 23 causes a tone deadening start operation, similar to that of step S23, to be performed on the tone signal corresponding to the tone pitch of the received key-off data 8*x*.

The reception section 23 goes to step S33 to generate released key position data Ax corresponding to the key-off data 8*x* received at step S29 above. Then, the reception section 23 converts the value of the generated released key position data Ax into virtual damper position data on the basis of the Ax data conversion table at step S34. At next step S35, the reception section 23 changes the current stored value in the Ax register corresponding to the tone pitch of the current received key-off data 8*x*, by changing the value of the Ax register with the converted value (i.e., by overwriting the value of the Ax register with the converted value).

YES determination is made at step S30 when the key-off data 8*x* has been generated after a tone generator key-on state without any released key position data Ax being generated (e.g., because of very quick key release operation). Thus, upon the YES determination at step S30, the reception section 23 generates, through the operation of step S31, released key position data Ax indicative of a position corresponding to the keyboard key-off position (threshold value K2), in order to provide released key position data Ax for the key release operation corresponding to the current received released key position data Ax.

If the current stored value in the key-on/key-off register, corresponding to the tone pitch indicated by the key number included in the key-off data 8*x* is already the value indicative of the key-off state (i.e., tone generator key-off) (NO determination at step S30) when the key-off data 8*x* has been received from the keyboard unit 20 (YES determination at step S29), the reception section 23 goes to steps S36 to S38, where operations similar to steps S33 to S35 above are performed to generate released key position data Ax indicative of a position corresponding to the keyboard key-off position (threshold value K2), convert the generated released key position data Ax to virtual damper position data on the basis of the Ax data conversion table and then change the value of the Ax register with the converted value.

NO determination is made at step S30 when the current stored value in the key-on/key-off register, corresponding to the tone pitch indicated by the key number included in the current received key-off data 8*x* is already indicative of the tone generator key-off state, i.e. tone deadening control (i.e., release control) is already under way for the key number included in the current received key-off data 8*x* (i.e., tone pitch to be processed this time) with released key position data Ax already received via the reception section 23 prior to the receipt of the current released key position data Ax.

After the change of the value of the Ax register at step S35 or S38, the reception section 23 goes to step S39, where the virtual damper position data generation section 24 is caused to start the later-described virtual damper position data generation and setting process of FIG. 10 on the key number included in the current received released key position data Ax (i.e., tone pitch to be processed).

Further, when damper pedal position data Bx40 has been received from the keyboard unit 20 (YES determination at step S40), the reception section 23 changes the value of the received Ax damper pedal position data Bx40 into virtual damper position data on the basis of the Ax data conversion table at step S41, and it then goes to step S42 to change the current stored value in the Bx40 register with the virtual damper position data, corresponding to the tone pitch of the current received damper pedal position data kBx40, by changing the value of the Bx40 with the converted value (i.e., by overwriting the value of the Bx40 register with the converted value). The Bx40 data conversion table is prestored in the flash memory 3 or RAM 4, which defines, for each possible value of damper pedal position data Bx40 (i.e., for each possible damper pedal position), to which one of values capable of being taken by the virtual damper position data (i.e., values of the virtual movable range of the virtual damper) the value of the damper pedal position data Bx40 corresponds. Similarly to the Ax data conversion table, the Bx40 data conversion table is provided for the purpose of converting damper pedal position data Bx40 into a value corresponding to virtual damper position data in order to absorb a difference between an operational characteristic of a damper member responsive to the key release operation and that responsive to operation of the damper pedal.

Following the change of the current stored value in the Bx40 register at step S42, the reception section 23 goes to step S43, where the virtual damper position data generation section 24 is caused to start the later-described virtual damper position data generation and setting process of FIG. 10 on every key number for which the current stored value in the key-on/key-off register is indicative of the tone generator key-on state (i.e., every tone pitch being currently sounded).

Furthermore, when sostenute pedal data Bx42 has been received from the keyboard unit 20 (YES determination at step S44), the reception section 23 determines, at step S45, whether the received sostenute pedal data Bx42 is sostenute pedal-on data or sostenute pedal-off data.

If the received sostenute pedal data Bx42 is sostenute pedal-on data (YES determination at step S45), the reception section 23 checks current stored values in the key-on/key-off registers of all of the tone pitches and detects all of the key-on/key-off registers whose current stored values are indicative of the "key-on (tone generator key-on)" state, at step S46. Then, at step S47, the reception section 23 changes the current stored value in the Bx register into the value indicative of the sostenute pedal-on state for each of the key numbers (tone pitches) corresponding to the key-on/key-off registers detected at step S46. In this manner, the operational state of the sostenute pedal is set to the ON state for all of the tone pitches currently in the tone generator key-on state.

If, on the other hand, the received sostenute pedal data Bx42 is sostenute pedal-off data (NO determination at step S45), the reception section 23 goes to step S48, where it changes the value of each of the Bx42 registers (corresponding to all the tone pitches), which corresponds to a tone pitch that is currently in the sostenute pedal-on state at the time of the receipt of the current sostenute pedal data Bx42, to the value indicative of the sostenute pedal-off.

After the change of the value(s) of the Bx register(s) at step S47 or S48, the reception section 23 proceeds to step S49, where the virtual damper position data generation section 24 is caused to start the later-described virtual damper position data generation and setting process of FIG. 10 on each tone pitch to be processed. Namely, if the reception section 23 has proceeded to step S49 by way of step S48, all of the tone pitches corresponding to the Bx42 registers whose values were changed at step S48 above are set as objects to be processed in the process of FIG. 10, or if the reception section 23 has proceeded to step S49 by way of step S47, all of the key numbers (tone pitches) detected at step S46 above are set as objects to be processed in the process of FIG. 10.

Note that the value of the Ax register updated at step S25, S27, S35 or S38 is reset once a next key-on event occurs.

Figure 10:
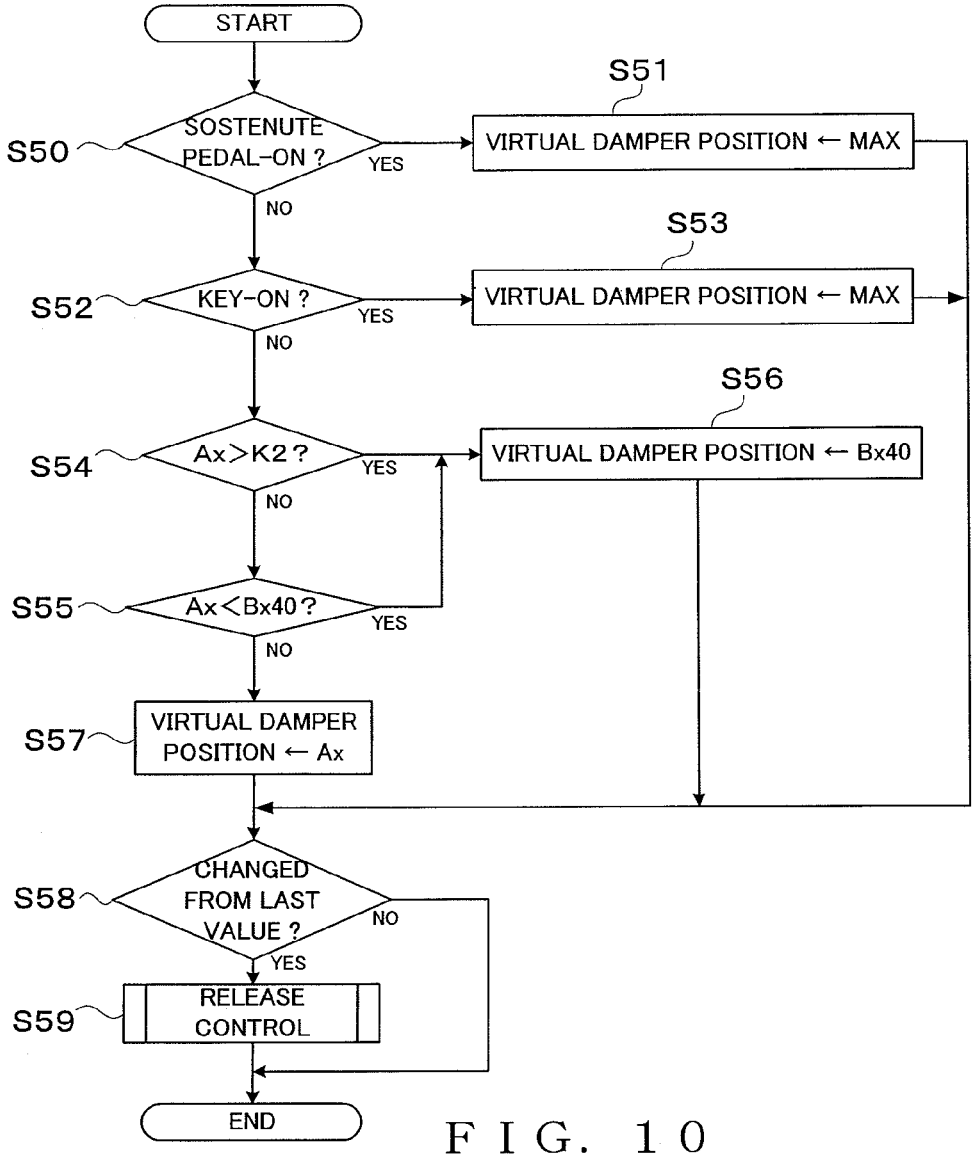
FIG. 10 is a flow chart showing a sequence of operations of a virtual damper position data generation and setting process performed by a virtual damper position data generation section shown in FIG. 2.

FIG. 10 is a flow chart showing a sequence of operations of the virtual damper position data generation and setting process performed by the virtual damper position data generation section 24. This virtual damper position data generation and setting process, which is also implemented by a software program executed by the CPU 2, is invoked or activated at step S18, S28, S39, S43 or S49 and performed individually on each tone pitch to be processed (or object to be processed). The purpose of this process is to generate and set virtual damper position data on the basis of the current stored values in the key-on/key-off register, Ax register, Bx40 register and Bx42 register updated through the process of FIGS. 8 and 9. The following describe an example of the virtual damper position data generation and setting process where virtual damper position data is generated and set for one key (tone pitch).

If the current stored value in the Bx42 (sostenute pedal data) register of the key in question is indicative of the "sostenute pedal-on" state (YES determination at step S50), the virtual damper position data generation section 24 sets the value of the virtual damper position data at a predetermined maximum value at step S51. Further, if the current stored value in the key-on/key-off register of the key in question is indicative of the key-on state (YES determination at step S52), the virtual damper position data generation section 24 sets the value of the virtual damper position data at a predetermined maximum value at step S53. The "maximum value of the virtual damper position data" is, as noted above, data indicative of a position of the damper member remotest from the string, i.e. a maximum damper release position. Thus, if there is any key currently in the key-on state when sostenute pedal-on data has been received, or when key-on data 9*x* has been received, the aforementioned operation permits simulation of a damper locking action responsive to operation of the sostenute pedal or movement of the damper member away from the string responsive to key depression operation in the acoustic piano.

If the current stored value in the Ax (released key position data) register is not greater than the threshold value K2 (i.e., closer to the value of the end position than the threshold value K2) (NO determination at step S54) when the current stored value in the Bx42 (sostenute pedal data) register is indicative of the sostenute pedal-off state and the current stored value in the key-on/key-off register is indicative of the key-off state (i.e., when the determination at step S50 is NO and the determination at step S52 is NO), the virtual damper position data generation section 24 compares the current stored value in the Ax register and the current stored value in the Bx40 (damper pedal position data) register. If the current stored value in the Bx40 register (i.e., current damper pedal position) is greater than the current stored value in the Ax register (i.e., YES determination at step S55), the current stored value in the Bx40 register is set as a value of the virtual damper position data at step S56. If, on the other hand, the current stored value in the Ax register is greater than the current stored value in the Bx40 register (i.e., NO determination at step S55), the current stored value in the AX register is set as a value of the virtual damper position data at step S57. Namely, one of the current stored values in the Ax register and Bx40 register which is indicative of a greater damper release position is determined and generated as official virtual damper position data.

Where damper control responsive to operation of a key and damper control responsive to operation of a damper pedal are simultaneously employed in the acoustic piano, a damper position is determined in response to one of these operations that moves the damper member more greatly than the other, and thus, it is a rational or reasonable choice to give priority, at step S55 above, to event data that, as a virtual-damper-position-data determining factor, sets the virtual damper position data at a greater value.

Further, if the current stored value in the Ax (released key position data) register is greater than the threshold value K2 (YES determination at step S54) when the current stored value in the Bx42 register is indicative of the sostenute pedal-off state and the current stored value in the key-on/key-off register is indicative of the key-off state (i.e., when the determination at step S50 is NO and the determination at step S52 is NO), the virtual damper position data generation section 24 sets the current stored value in the Bx40 register as a value of the virtual damper position data at step S56. Further, if the electronic piano is not constructed to receive released key position data Ax (i.e., the electronic piano is of a model type having no mechanism for detecting released key position data Ax), no new value is stored into the Ax register; namely, the Ax register always has stored therein an initial value that is greater than the threshold value K2.

If the current value of the virtual damper position data set at step S51, S53, S56 or S57 has changed from the last value (YES determination at step S58), the virtual damper position data generation section 24 transfers the currently-set virtual damper position data to the envelope generation (EG) section 29 and causes the envelope generation section 29 to perform a process for controlling a release characteristic (e.g., release rate), at step S59.

Figure 11:
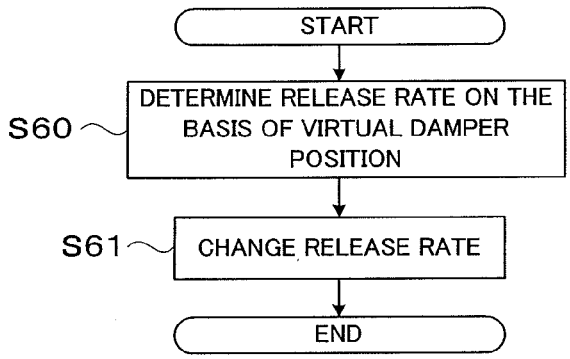
FIG. 11 is a flow chart showing an operational sequence of a release rate change process performed by the envelope generation section of FIG. 2.

FIG. 11 is a flow chart showing an operational sequence of a release rate change process performed by the envelope generation (EG) section 29. This release rate change process, which is invoked or activated from step S59 of FIG. 10, is performed individually for each of the tone pitches set as objects to be processed in the virtual damper position data generation and setting process of FIG. 10. The number of the tone pitches to be processed in the process of FIG. 10 differs depending on from which of steps S18, S28, S39, S43 and S49 the process of FIG. 10 has been activated. The process of FIG. 10 is designed to perform operations for one tone pitch per activation as noted above, and thus, if a plurality of tone pitches are to be processed, the process of FIG. 10 is activated a plurality of times corresponding to the plurality of tone pitches to be processed. The release rate change process of FIG. 11 is performed individually for each of the tone pitches set as objects to be processed in the process of FIG. 10 as noted above, and thus, if the process of FIG. 10 is activated a plurality of times, the process of FIG. 11 is executed the same plurality of times. The release rate change process of FIG. 11 too is implemented by a software program executed by the CPU 2.

At step S60 of FIG. 11, the envelope generation (EG) section 29 determines a value of a release rate of an envelope signal on the basis of the virtual damper position data set at step S51, S53, S56 or S57. Then, at step S61, the envelope generation (EG) section 29 changes the release rate to the determined value. The acoustic piano has the release characteristic that the release rate presents a gentler slope as the damper member is located remoter from the string while the release rate presents a steeper slope as the damper member is located closer to the string. Thus, in the instant embodiment, the setting of the release rate is performed with reference to the virtual damper position data in such a manner that the release rate is set at a value of the gentlest slope when the virtual damper position data is of the maximum value and the slope of the release rate gradually becomes steeper as the virtual damper position data decreases in value. For such setting of the release rate, there is provided, for example, a release conversion table that defines values of the release rate corresponding to possible values of the virtual damper position data, and each damper position data is converted into a release rate on the basis of the conversion table. In the aforementioned manner, the envelope generation section 29 generates an envelope signal having the release rate determined on the basis of the virtual damper position data.

At individual sampling periods from tone generator key-on timing, the envelope generation section 29 sequentially outputs values of an attack rate, decay rate and sustain rate and generates an envelope signal comprising an attack portion, decay portion and sustain portion. Then, in response to tone generator key-off timing, the envelope generation section 29 performs release control (i.e., tone deadening control) on a tone signal in question using the envelope signal having the release rate newly set at step S61 above. Thus, release control corresponding to the current value of the virtual damper position data is performed. Thus, the release rate can be varied in real time if the release rate is updated by the virtual damper position data being updated in response to operation of the key (released key position data) and operation of the damper pedal during the keyboard key-on state (i.e., during tone generation of a tone signal or tone deadening control).

As set forth above, when at least one of key-on data 9*x*, key-off data 8*x*, released key position data Ax, damper pedal position data Bx40, sostenute pedal-on data Bx42 and sostenute pedal-off data Bx42 has been received, the electronic piano 1 employing the embodiment of the tone control apparatus generates, by means of the virtual damper position data generation section 24, virtual damper position data on the basis of the received data and sets the thus-generated virtual damper position data as a parameter for determining a release rate. In this way, the electronic piano 1 can provide a construction for simulating the physical tone generating mechanism (release controlling mechanism) of the acoustic piano that controls a damper position (i.e., distance between the damper member and the corresponding string), and it can realistically and faithfully reproduce the release control in the acoustic piano via that simulating construction.

Whereas the embodiment of the tone control apparatus has been described above in relation to the case where the operation unit 5 of the electronic musical instrument (electronic piano) 1 includes the keyboard unit 20, damper pedal unit 21 and sostenute pedal unit 22, the tone control of the present invention (i.e., processes of FIGS. 8, 9, 10 and 11) can also be applied to an electronic musical instrument that does not have any one of the keyboard unit 20, damper pedal unit 21 and sostenute pedal unit 22. In such a case, the electronic musical instrument is different from the above-described electronic musical instrument only in that no data is generated from the unit not included in the electronic musical instrument (i.e., missing unit), and no particular change has to be made to the processes of FIGS. 8-11 to be performed by the reception section 23. Namely, in the processes of FIGS. 8 and 9, a NO determination, indicating that no data has been received, is always made at the reception determination step for the data to be generated from the missing unit. Further, the present invention is also applicable as-is to electronic keyboard instruments provided with a keyboard unit capable of generating only key-on and key-off data but incapable of generating released key position data (e.g., because the keyboard unit includes no released key position detection mechanism). Furthermore, the tone control of the present invention (i.e., processes of FIGS. 8, 9, 10 and 11) is also applicable, with no change of algorithms, to electronic instruments provided with a keyboard unit that has a different resolution of released key position data from that in the above-described keyboard unit 20. In such a case, it is desirable to prepare an Ax data conversion table corresponding to the different resolution of released key position data. As apparent from the foregoing, the above-described embodiment of the invention can achieve the superior advantageous benefit that the release control based on the virtual damper position data can be implemented with a reasonable construction having a high general versatility.

As a modification of the process shown in FIGS. 8 and 9, the value of the released key position data Ax or the value of the damper pedal position data Bx40 may be handled as-is or directly as the virtual damper position data without the table conversion being performed at steps S24, S26, S34, S37 and S41.

Furthermore, whereas the embodiment of the tone control apparatus has been described above as performing the release control of a tone signal assuming that the electronic piano 1 is played by a human player, the present invention is not so limited, and the release control of the present invention may also be applied to automatic performances where automatic performance data including at least one of key-on data 9*x*, key-off data 8*x*, released key position data Ax, damper pedal position data Bx40, sostenute pedal-on data Bx42 and sostenute pedal-off data Bx42 are reproduced. In such a case, it is only necessary that the keyboard unit 20, damper pedal unit 21 and sostenute pedal unit 22, which are MIDI event data supply sources to the reception section 23 of FIG. 2, be replaced with an automatic performance data supply unit.

Furthermore, whereas the embodiment of the tone control apparatus has been described above in relation to the case where the released key position data Ax is data that represents, with a 128-step resolution, a position, along the operating direction, of a key being released, the present invention is not so limited. For example, the present invention may be constructed to output a value of the released key position data Ax for each of several regions set within the range from the rest position to the end position; as an example, the present invention may be constructed to output four-step released key position data Ax for the four regions defined by the threshold values K2, K2A, K2B, K2C and K4.

Further, in the case where the present invention is constructed to output a value of the released key position data Ax for each of several regions, the key sensor included in the keyboard unit 20 need not detect key positions (changing key position) in continuous or successive amounts, and it may be constructed to detect passage through several threshold values (such as the threshold values K2, K2A, K2B, K2C and K4 shown in FIG. 3) along the operating direction of the key.

Furthermore, whereas the embodiment of the tone control apparatus has been described above as applied to an electronic piano, it is also applicable to apparatus having a function of electronically generating tone signals, such as electronic musical instruments like synthesizers and electronic organs and tone signal generation apparatus having a function of performing a process for electronically generating tone signals, and software programs for causing a computer to perform a process for electronically generating tone signals. The present invention can achieve significant advantageous benefits particularly in generating tone signals of piano-type tone colors.

The present application is based on, and claims priority to, Japanese Patent Application No. 2008-283612 filed on Nov. 4, 2008. The disclosure of the priority application, in its entirety, including the drawings, claims, and the specification thereof, is incorporated herein by reference.

What is claimed is:

1. A tone control apparatus for electronically simulating a physical tone generating mechanism of an acoustic piano provided with a damper member for suppressing vibration of a corresponding string, said tone control apparatus comprising:

a supply section that supplies at least one of key-on data indicative of a start of tone generation, key-off data indicative of a start of tone deadening, released key position data indicative of a position, along a key operating direction, of a key being released, damper pedal position data indicative of a position, along a damper-pedal operating direction, of a damper pedal, sostenute pedal-on data indicative of an ON state of a sostenute pedal and sostenute pedal-off data indicative of an OFF state of the sostenute pedal;

a virtual damper position data generation section that generates virtual damper position data on the basis of the at least one of the key-on data, key-off data, released key position data, damper pedal position data, sostenute pedal-on data and sostenute pedal-off data supplied by said supply section, the virtual damper position data being data simulatively representing a position of the damper member provided for suppressing vibration of the corresponding string;

a tone signal generation section that generates a tone signal on the basis of the key-on data; and a release control section that, on the basis of the virtual damper position data generated by said virtual damper position data generation section, controls a release characteristic of the tone signal to be generated by said tone signal generation section.

2. The tone control apparatus as claimed in claim 1 wherein, when the sostenute pedal-on data or the key-on data has been supplied, said virtual damper position data generation section sets the virtual damper position data at a value corresponding to a maximum damper release position.

3. The tone control apparatus as claimed in claim 1 wherein said virtual damper position data generation section generates the virtual damper position data on the basis of at least one of the released key position data and the damper pedal position data supplied after supply of the sostenute pedal-off data or the key-off data.

4. The tone control apparatus as claimed in claim 3 wherein, when both the released key position data and the damper pedal position data have been supplied, said virtual damper position data generation section compares the released key position data and the damper pedal position data supplied and generates the virtual damper position data on the basis of one of the released key position data and the damper pedal position data which has a value corresponding to a greater damper release position.

5. The tone control apparatus as claimed in claim 3 wherein, when only one the released key position data and the damper pedal position data has been supplied, said virtual damper position data generation section generates the virtual damper position data on the basis of the released key position data or the damper pedal position data supplied.

6. The tone control apparatus as claimed in claim 1 wherein said virtual damper position data generation section includes a first table for converting released key position data to virtual damper position data and a second table for converting damper pedal position data into virtual damper position data, and wherein one of the virtual damper position data, converted via the first and second tables, which is indicative of a greater damper release position is determined and generated as the virtual damper position data.

7. The tone control apparatus as claimed in claim 1 wherein said virtual damper position data generation section includes:

a first setting section that, when the sostenute pedal-on data or the key-on data has been supplied, sets the virtual damper position data at a value corresponding to a maximum damper release position; and a second setting section that, when both the released key position data and the damper pedal position data have been supplied after supply of the sostenute pedal-off data or the key-off data, compares the released key position data and the damper pedal position data supplied and sets, on the basis of a result of the comparison, a value of the virtual damper position data to be generated, and that, when only any one of the released key position data and the damper pedal position data has been supplied after supply of the sostenute pedal-off data or the key-off data, sets, on the basis of the released key position data or the damper pedal position data supplied, a value of the virtual damper position data to be generated.

8. The tone control apparatus as claimed in claim 1 wherein said release control section controls a release characteristic of a tone volume envelope signal imparting the tone signal with timewise variation of a tone volume.

9. A tone control method for electronically simulating a physical tone generating mechanism of an acoustic piano provided with a damper member for suppressing vibration of a corresponding string, said tone control method comprising:

a supply step of supplying at least one of key-on data indicative of a start of tone generation, key-off data indicative of a start of tone deadening, released key position data indicative of a position, along a key operating direction, of a key being released, damper pedal position data indicative of a position, along a damper-pedal operating direction, of a damper pedal, sostenute pedal-on data indicative of an ON state of a sostenute pedal and sostenute pedal-off data indicative of an OFF state of the sostenute pedal;

a virtual damper position data generation step of generating virtual damper position data on the basis of the at least one of the key-on data, key-off data, released key position data, damper pedal position data, sostenute pedal-on data and sostenute pedal-off data supplied by said supply step, the virtual damper position data being data simulatively representing a position of the damper member provided for suppressing vibration of the corresponding string;

a tone signal generation step of generating a tone signal on the basis of the key-on data; and a step of, on the basis of the virtual damper position data generated by said virtual damper position data generation step, controlling a release characteristic of the tone signal to be generated by said tone signal generation step.

* * * * *